United States Patent [19]

Adams et al.

[11] 3,958,283

[45] May 25, 1976

[54] ELEVATING AND TRENDELENBURG MECHANISM FOR AN ADJUSTABLE BED

[75] Inventors: James S. Adams; William H. Peck; Daniel R. Tekulve, all of Batesville, Ind.

[73] Assignee: Hill-Rom Company, Inc., Batesville, Ind.

[22] Filed: Aug. 9, 1974

[21] Appl. No.: 496,212

[52] U.S. Cl. ..... 5/66; 5/68

[51] Int. Cl.[2] ..... A61G 7/14

[58] Field of Search ..... 5/11, 62, 63, 66, 69

[56] References Cited

UNITED STATES PATENTS

| | | | |
|---|---|---|---|
| 3,149,348 | 9/1964 | Hillenbrand | 5/63 |
| 3,220,020 | 11/1965 | Nelson | 5/63 |
| 3,222,693 | 12/1965 | Pruim | 5/63 |
| 3,478,372 | 11/1969 | Benoit et al. | 5/63 |
| 3,527,111 | 10/1950 | Wadrich | 5/11 |
| 3,711,876 | 1/1973 | Kirkland | 5/62 |
| 3,821,821 | 7/1974 | Burst et al. | 5/68 |
| 3,840,910 | 10/1974 | Damico | 5/66 |

*Primary Examiner*—Casmir A. Nunberg
*Attorney, Agent, or Firm*—Robert V. Jambor

[57] ABSTRACT

An elevating and Trendelenburg mechanism for a hospital bed providing elevated Trendelenburg positions and positive latching of cooperating members. Two torque tubes pivotally attach to an elevating frame. Lift arms welded to the torque tubes support the frame at various elevations. A motor on the frame produces rotation of a yoke pivotally attached to one of the torque tubes. The yoke abuts a first drive arm rigidly attached to the tube to lift one end of the frame, and a second drive arm pivotally attached to the tube. A rod connects the second drive arm to a pivot plate as a second rod connects the pivot plate to a third drive arm welded to the other torque tube to lift the other end of the bed. When the frame raises to about its maximum height, one of two hooks on the frame may prevent the first or second drive arm from following a receding yoke, with the result that one end of the bed remains elevated while the other lowers. When not so engaged with the hooks, the second and third drive arms latch onto the yoke to prevent externally produced relative motion of the components.

41 Claims, 11 Drawing Figures

F

ELEVATING AND TRENDELENBURG MECHANISM FOR AN ADJUSTABLE BED

BACKGROUND

A hospital bed must generally have the ability to raise and descend. The lower position allows for the facile and safe entering upon and departing from off the bed. The higher position provides a convenient surface for the examination and treatment of the patient.

Moreover, positions tilted from the horizontal produce medical benefits for a number of maladies. Accordingly, beds for hospitals or other treatment facilities often include mechanisms which permit at least one end of the bed to raise higher than the other. Preferably either end may assume a higher position.

F. Pruim et al's U.S. Pat. No. 3,222,693 shows a bed with elevation and tilting mechanisms. That bed, however, descends to its lowest position before inclining into a Trendelenburg position. As a result, when in a tilt, the bed hovers near the floor. However, a patient in a Trendelenburg position often needs the intensive care of others. The lowness of this bed makes that care more difficult.

Another bed which also assumes a Trendelenburg position from its lowest elevation appears in U.S. Pat. No. 3,478,372 issued to R. A. Benoit et al. As with Pruim et al., this bed has two torque tubes which rotate in the same direction in elevating the bed, which they also do in lowering the bed. To overcome the translation thus introduced, Benoit et al. have double linked arms on the torque tubes, as well as telescoping legs.

U.S. Pat. Nos. 2,527,111 to A. Widrich and 3,149,348 to W. A. Hillenbrand show beds without Trendelenburg mechanisms. While possessing torque tubes which rotate in opposite directions to raise or lower the bed, the tubes do not appear on the bed frame undergoing elevation or lowering. Consequently, each possess auxiliary guiding means to retain the mattress in the proper position.

T. Nelson, in his U.S. Pat. No. 3,220,020 shows the opposite rotation of components to elevate a bed. However, his bed also requires telescoping legs which limit the total possible elevation as well as deleteriously extending the external dimensions of the bed.

Recent significant improvements in adjustable beds appear in the U.S. Pat. Nos. 3,711,876 to Kirkland et al. and 3,821,821 to F. J. Burst et al. However, the search continues for elevating and Trendelenburg mechanisms providing greater versatility, longevity and compactness.

SUMMARY

Providing an elevating bed with two pivotally attached torque tubes rotating in the opposite directions in raising or lowering the frame produces significant advantages in the operation of the bed. The lifting means, such as arms, which attach to the torque tubes, will also move in opposite directions and minimize any induced translational motion of the bed.

The bed also includes a motor or some motive means supplying the required power to drive means attached to the torque tubes. With these tubes rotating in opposite directions, the motor may more readily locate between them, rather than at the end of the bed. This arrangement finds particular use in the type of bed whose foot moves towards the head when the latter rises.

This bed can also incorporate a Trendelenburg mechanism which provides tilting positions when elevated from the floor. To accomplish this, the elevating frames raise to a predetermined height, desirably about its maximum elevation. Subsequently, an actuating means, such as a rod, moves a retaining means into a position of engagement where it prevents the rotation of one torque tube. The unrestricted tube lowers its end of the bed to achieve the desired inclination.

More generally, the bed thus has, in addition to an elevating mechanism to raise and lower the frame, a tilting device. The latter retains one end of the frame after it has reached the preselected height. The subsequent descent of the other produces the Trendelenburg configuration.

Additionally, the bed may also include a restraining device to limit the relative motion of the components produced by external forces. Specifically, the device should limit movement between the frame and the elevating mechanism upon the lifting of either end of the bed from a level position. Accordingly, when raised by hand, for example, these components will not separate from each other.

DETAILED DESCRIPTION

Figure 1:
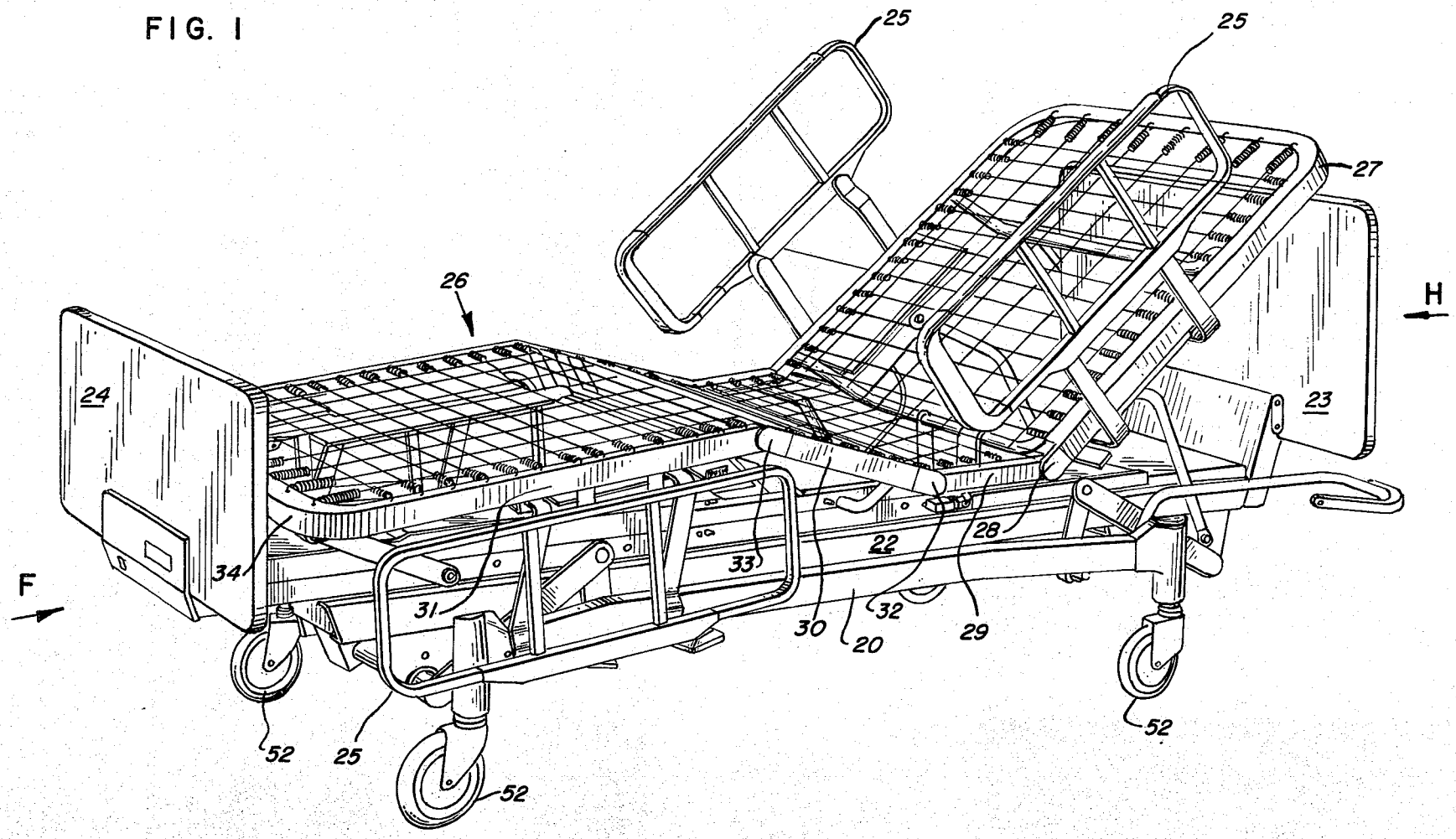
FIG. 1 illustrates a bed having the usual head and knee adjustments as well as an elevating mechanism.

The bed in FIG. 1 includes adjustable portions in their configured or contoured positions. Many of them have become standard for hospital and nursing home beds.

The bed has a base frame 20 supporting it on the floor. The elevating frame 22 incorporate the structure that allows the bed to rise, descend, or tilt and also supports the remaining components at the chosen elevation.

A headboard 23 appears at the head H of the bed while a footboard 24 stands at its foot F. Sideguards 25 serve a safety function for the patient on the bed.

The bed further has a segmented spring, indicated generally at 26, with a mesh or other structure to support a mattress. The segmentations in the spring allow it to assume the various configurations.

As one end of the bed appears the head portion 27 of the spring. It pivots about an axis through the point 28 to elevate the patient's head.

U.S. Pat. No. 3,237,212 W. A. Hillenbrand et al. shows a vastly superior head elevating mechanism which moves the bed towards its head as the latter raises. This allows the patient's head to remain near the wall and the usual auxiliary equipment.

The middle section 29 connects to the head portion 27 at the point 28. It remains fixed to the frame and generally displays no indepent motion.

The knee position of the bed consists of a thigh segment 30 and a foot segment 31. The former connects to the middle section 29 at the point 32 about which it rotates to elevate the thigh.

The foot section 31 pivotally connects to the thigh section 30 at the point 33. Rotation about the point allows for the flexing of the patient's knee. Upon raising the knee, the end 34 of the foot section may elevate slightly, as shown, for added comfort.

Figure 2:
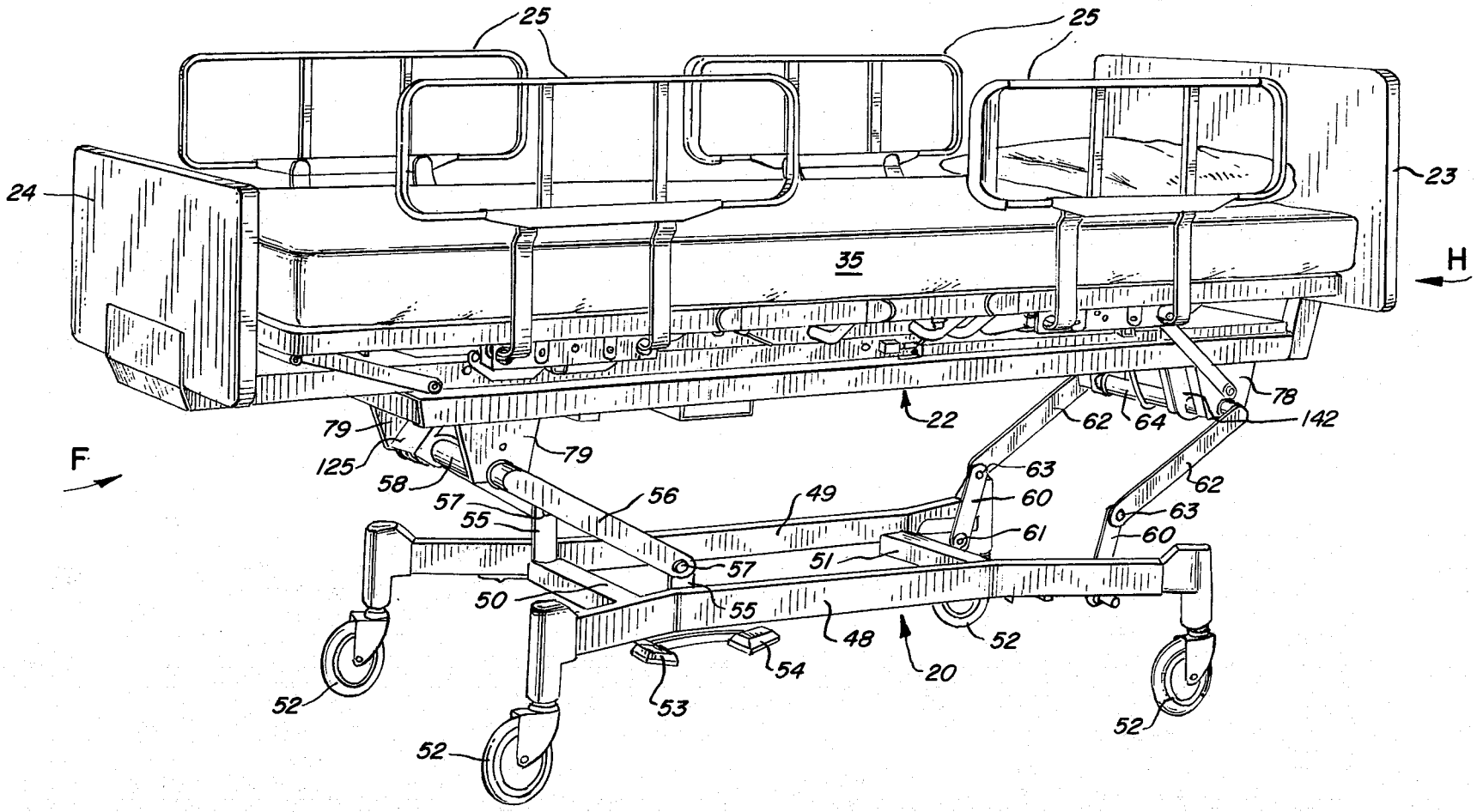
FIG. 2 shows the bed of FIG. 1 in an elevated configuration.

The bed in FIG. 2 shows externally the relationship of the various components in the bed's most elevated position with the spring completely flat. The figure also shown the mattress 35 in place.

Figure 3:
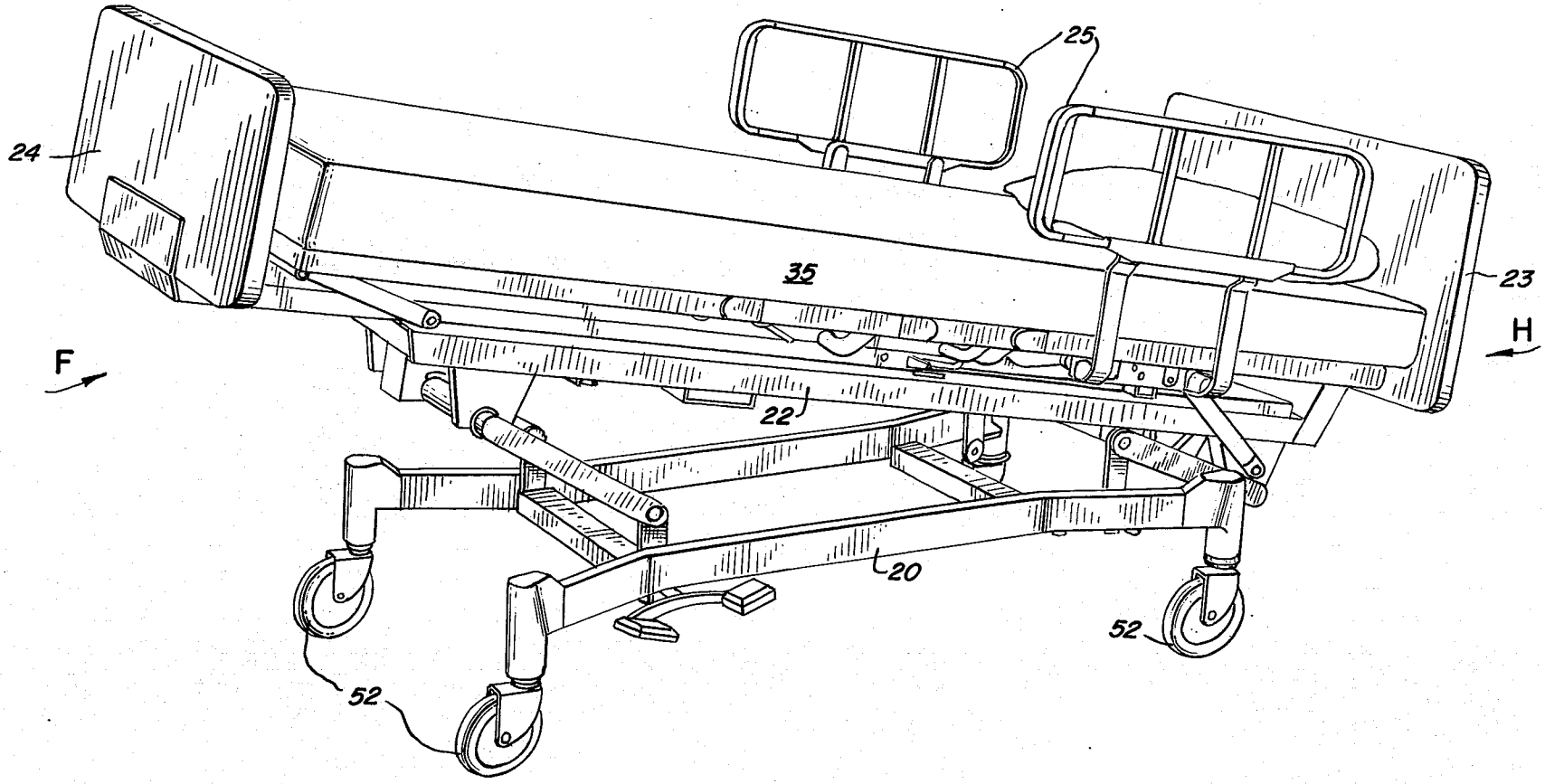
FIG. 3 portrays the bed of FIGS. 1 and 2 in a Trendelenburg position.

FIG. 3 shows the bed in a Trendelenburg position in which the head H sets at a lower level than the foot F. A reverse Trendelenburg position has the opposite situation of the foot F lower than the head H.

Returning to FIG. 2, the base frame 20 includes the two elongated bars 48 and 49. The cross bars 50 and 51 rigidly attach to the elongated bars 48 and 49 as by welding. The base frame 20 may also include casters 52, as well as mechanisms to lock the casters or to lock their direction allowing a single person to move the bed. The pedals 53 and 54 control these breaking and directional components.

The base frame 20 also includes the two pivot plates 55 located at one end of the elongated bars 48 and 49 and generally in the region of the cross bar 50. These plates rigidly adhere to the frame and cannot move. The lift arms 56 pivotally attach to the pivot plates 55 at the points 57. The torque tube 58 is rigidly attached to both of the lift arms 56 and causes them to rotate together about the points 57.

Pivot arms 60 rotatingly attach to the base frame 20 at the points 61. They appear generally at the end of the frame opposite from the pivot plates 55. The lift arms 62 attach to the pivot arms at the points 63 about which they are free to rotate. The torque tube 64 limits the lift arms 62 to rotating together about the points 63.

Figure 4:
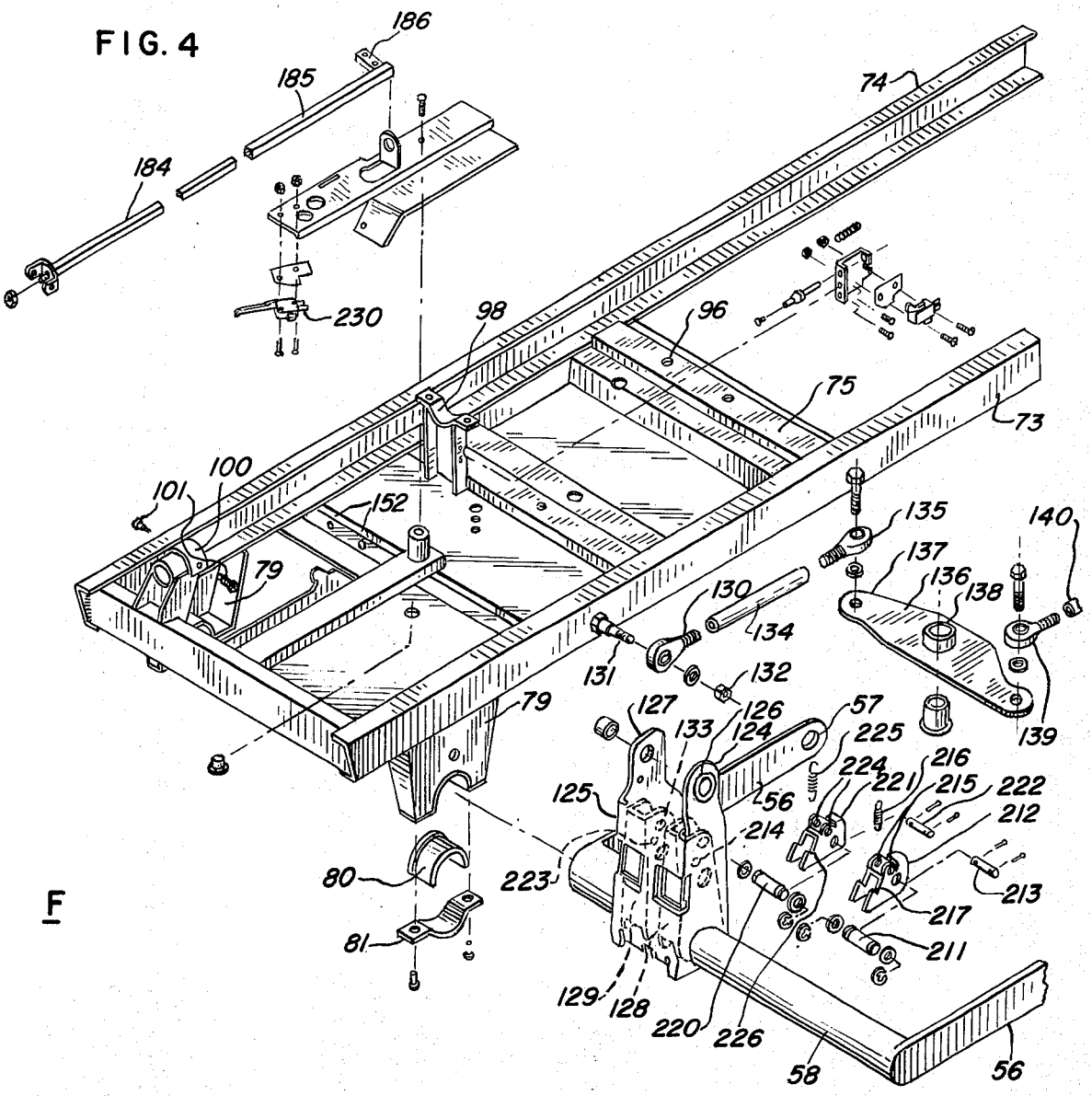
FIG. 4 has an exploded view of the elements forming the elevating and Trendelenburg mechanism in the bed.
Figure 4:
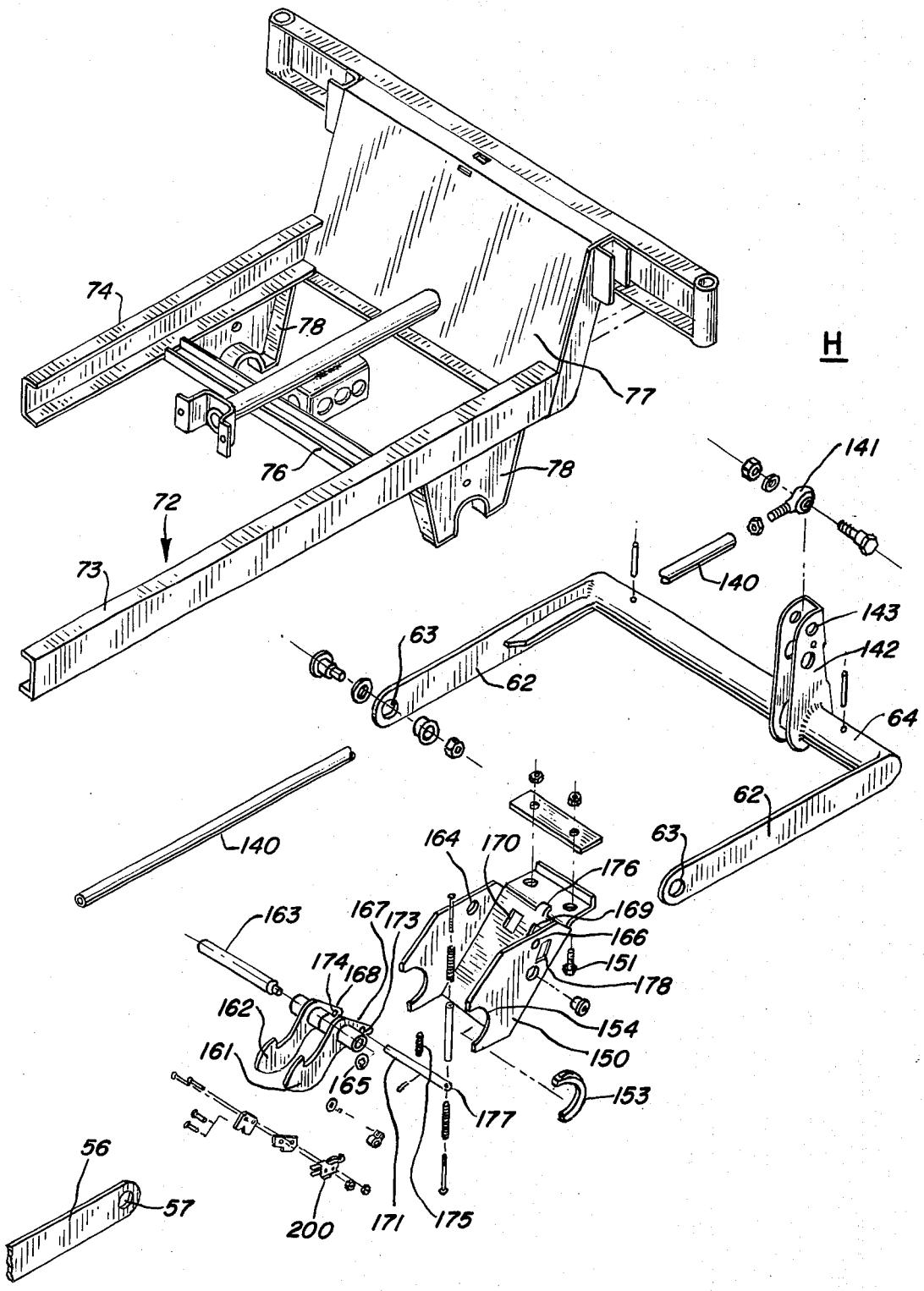

As shown in FIG. 4, the elevating frame 72, located above the base frame 20, includes the elongated channels 73 and 74, held together by the plate 75, bar 76, and end plate 77. The torque tube brackets 78 of the head end H of the elevating frame 72 sit on the torque tube 64. The torque tube brackets 79, forming part of the foot end F of the elevating frame 72, similarly rest upon the torque tube 58. At each of the four torque tube brackets 78 and 79, a bushing 80 and a clamp 81 pivotally secure the torque tubes 58 and 64 to the elevating frame 72.

To raise the elevating frame 72 and, thus, the mattress, the lift arms 56 rotate about the points 57 and the lift arms 62 about the points 63. Rotating the lift arms 56 rotates the torque tube 58 in the torque tube bracket 79 causing them to raise. The foot end F of the bed will also elevate with the brackets 78. Similarly, rotating the lift arms 62 about the points 63 raises the torque tube 64, the torque tube bracket 78, and the head end H of the bed.

The elongated channels 73 and 74 of the elevating frame 72 maintain a fixed distance between the torque tube brackets 78 and 79 on either side of the bed. Consequently, the torque tube 58 always maintains a fixed separation from the torque tube 64. As a result, rotating the lift arms 56 and the arms 62 changes the distance between the pivot points 57 and 63. The pivot arms 60 pivot about the points 61 to compensate for this changing distance.

Figures 5, 6:
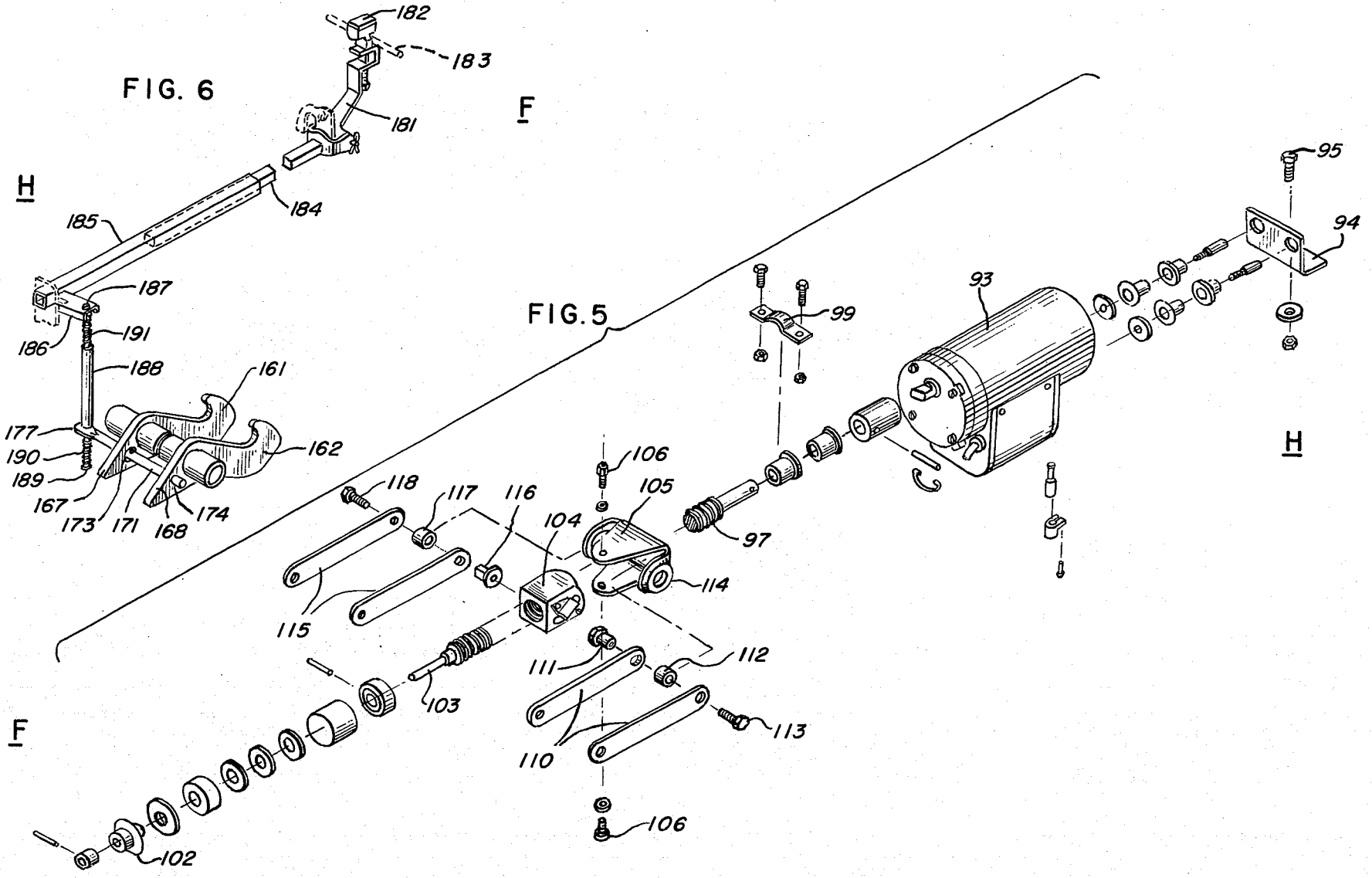
FIG. 5 gives an exploded view of the motor for the bed's elevating mechanism and its connections to the other moving parts.
FIG. 6 shows the interconnections between the selection knob for the Trendelenburg positions and the involved mechanism.

The motor 93 in FIG. 5 provides the power to raise and to control the descent of the elevating frame 72. The mounting bracket 94 attaches to the motor 93. The bolt 95 passing through the hole 96 on the plate 75 affixes the motor to the elevating frame 72. The motor's power couples to the screw 97 which the clamp 99 mounts to the elevating frame 72 at the screw support bracket 98 (of FIG. 4). More importantly, the thrust block 100, held in place on the elevating frame 72 by screws 101 (in FIG. 4), supports the bearing block 102 which contains the end 103 of the screw 97. In operation, the thrust block 100 supports the thrust load exhibited by the screw 97 due to the weight of the bed.

The nut 104 fits on the screw 97 and translates its rotation into linear motion. The screws 106 retain the trunnion 105 in a fixed relationship to the nut 104. The two connecting links 110 pivotally attach to the one of the trunnion 105 through the shoulder nut 111, bushing 112 and screw 113, with the bushing 112 fitting inside the bushing housing 114 of the trunnion 105. The two connecting links 115 similarly pivotally attach to the other side of the trunnion 105 through the shoulder nut 116, the bushing 117 and the screw 118.

The connecting links 110 pivotally attach to the boss 124 of the yoke 125 in FIG. 4 with the same arrangement of nut, screw and bushing through the bushing housing 126 as with their connection to the bushing housing 114 of the trunnion 105. Similarly, the connecting links 115 connect to the other boss 127 of the yoke 125.

The yoke 125 pivots on and connects to the torque tube 58. Inside of the yoke 125, however, lie two drive arms 128 and 129, shown in phantom. The foot drive arms 128, welded to the torque tube 58, cannot pivot about that tube. The pivotal head drive arm 129, however, remains free to pivot about the torque tube 58. Consequently, when the trunnion 105 moves, the connecting links 110 and 115 undergo motion. In particular, when the trunnion 105 moves toward the motor, it also pulls the yoke 125 in that direction. As the yoke 125 approaches the motor, it abuts and moves the foot drive arm 128 causing it to rotate the torque tube 58 in the torque tube bracket 79. The rotation of the torque tube 58 results in the lifting of the foot end F of the bed.

The rod end 130 is pivotally connected to the pivotal head drive arm 129 by the nut 132 and the screw 131 passing through the opening 133. When the yoke 125 moves toward the motor 93, it also abuts against the head drive arm 129 which moves the rod end 120 towards the head of the bed. This motion passes through the tie rod 134 to its other end 135 which connects to the end 137 of the pivot plate 136. As the pivot plate 136 rotates about its center 138 the rod end 139, the rod 140, and the rod end 141 move away from the head H of the bed. The rod end 141 consequently pulls the fixed head drive arm 142, to which it pivotally connects through the opening 143, toward the foot of the bed. The torque tube 64, welded to the fixed head drive arm 142 rotates in the torque tube bracket 78 raising the head end H of the bed.

Similarly, as the trunnion 105 and the links 110 and 115 move away from the motor 93, the yoke 125 rotates towards the foot F of the bed. Both the foot drive arm 128 and the pivotal head drive arm 129 remain in abutment against the yoke 125 and similarly move towards the bed's foot F. This motion of the foot drive arm 128 rotates the torque tube 58 in the bracket 79 and lowers that end of the bed. Similarly, the rod 134 and the pivot plate end 137 accompany the pivotal head drive arm 129 towards the foot F of the bed and rotate the pivot plate 136 about the point 138. This allows the rod 140 and the fixed head drive arm 143 to move towards the head of the bed and rotate the torque tube 64 in the bracket 78 to lower the head H of the bed.

However, when the bed reaches its highest position, characterized by the trunnion 105 coming closest to the motor 93, the Trendelenburg or the reverse Trendelenburg mechanism may then engage. A subsequent lowering of the bed allows only one end to decline with the other remaining in the elevated position. The inclined position results.

The Trendelenburg mechanism includes the Trendelenburg box 150 which the screws 151 attach to the mechanism plate 75 at the holes 152. The bearing 153 fits into the curved lower end 154 of the Trendelenburg box 150 and abuts against the torque tube 58 on each side of the yoke 125.

The Trendelenburg primary hook 161 and the reverse Trendelenburg primary hook 162 set within the Trendelenburg box 150 and pivot the rod 163. The rod 163 passes through the relatively large hole 164. However, the retaining ring 165 holds the shoulder on the rod 163 against the relatively small hole 166. The shoulder precludes the rod 163 from passing completely through the small opening 166.

Figure 10:
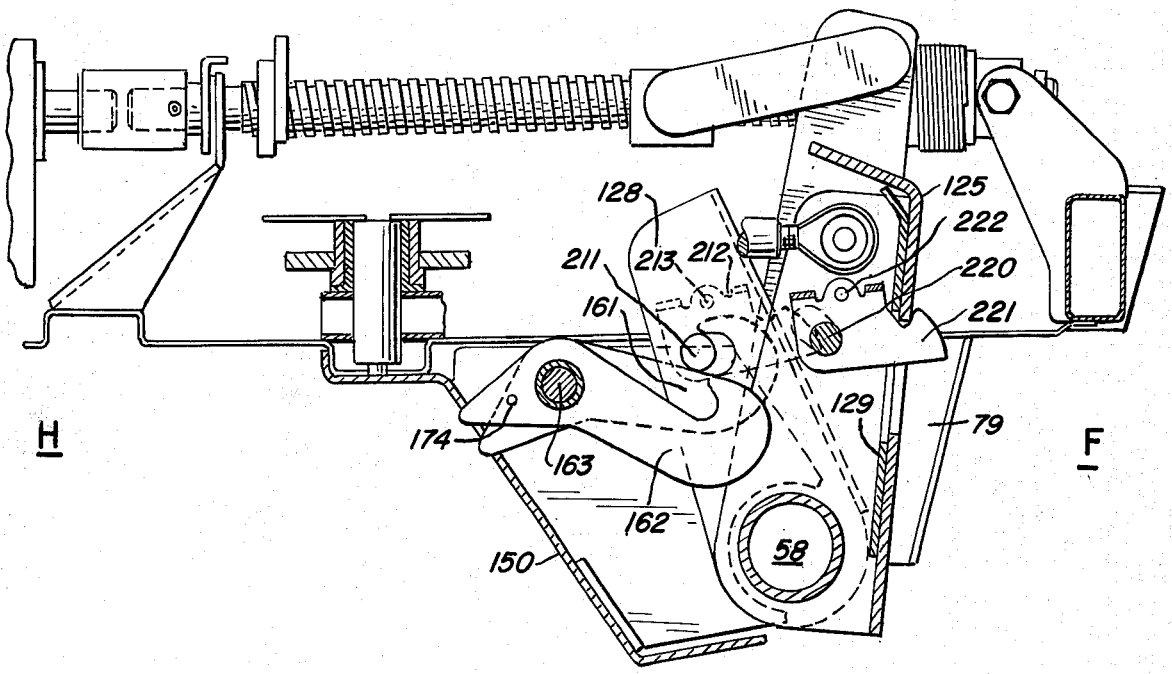
Figure 9:
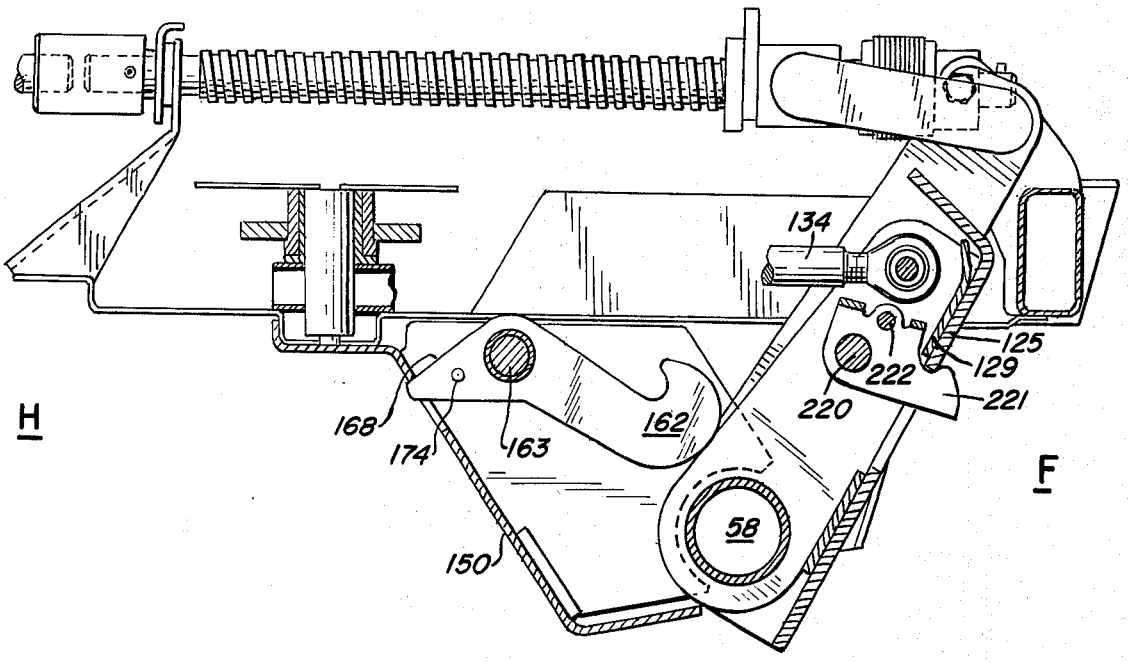

Inside the Trendelenburg box 150, the primary Trendelenburg and reverse Trendelenburg hooks 161 and 162 rest with their upper ends 167 and 168 against the tops of the openings 169 and 170, respectively, (as shown in FIGS. 9 and 10). This derives partially from a weight biasing of the hooks about the rod 163.

Moreover, the lever 171 passes through the openings 173 and 174 of the hooks 161 and 162. The spring 175 connects between the middle of the rod, between the hooks, and to the tab 176 and remains under an extensive force. This force pulls the rod 171 towards the tab 176 providing a spring biasing to maintain the back ends 167 and 168 of the hooks 161 and 162 against the tops of the openings 169 and 170.

The lever end 177 passes through the opening 178 of the Trendelenburg box 150. A downward or upward motion on the end 177 elevates the hook end of the hooks 161 or 162, respectively. As FIG. 6 shows, motion of the end 177 ultimately derives from the movement of the control lever 181, the rod assembly 184 and the tube arm assembly 185 into which the rod assembly 184 telescopes. This telescoping arrangement allows for the retraction of the bed frame as the head elevates.

The rotation of the tube arm assembly in one direction will raise the arm 186, the screw 187, the link 188 rigidly attached to the screw 187, and the screw 189, rigidly attached to the link 188. Compression of the spring 190 forces the lever end 177 upwards. The lever 171 then pivots about the opening 173 in the hook end 167 forcing down the end 168 of the hook 162, the hook portion of which accordingly rotates upwards. From above, the lever pivots about the opening 173 since the end 167 of the hook 161 abuts against the top of the opening 169 in the Trendelenburg box 150. With the hook 162 rotated upwards, a mechanical force overcoming the compression on the spring 190 will force it downwards, for purposes discussed below.

Conversely, when the arm 186 rotates downward, it compresses against the spring 191 and forces the link 188 downwards. This motion of the link 188 forces the lever end 177 to pivot the lever 171 around the opening 174 of the hook 162. As a result, the hook end 167 lowers and raises the hook 161. Again, sufficient force may override the compression in the spring 191 to force the hook 161 downward.

Thus, rotating the control lever raises or lowers the arm 186. When the arm 186 moves upward, it causes the lever 171 to pivot about the opening 173 and raise the reverse Trendelenburg hook 162. Descending, it pivots about the opening 174 to raise the Trendelenburg primary hook 161. It clearly cannot do both simultaneously. Accordingly, the mechanism prevents the simultaneous engagement of both the Trendelenburg primary hook 161 and the reverse Trendelenburg primary hook 162.

Furthermore, the middle portion of the lever 171 between the hooks 161 and 162 travels downwards whenever the arm 186 either raises or lowers. This motion permits the activation of the electrical switch 200 between the two hooks 161 and 162 by the lever 171 to indicate electrically that one or the other of the hooks are raised. This serves as a safety device to prevent the bed from attempting to assume either the Trendelenburg or reverse Trendelenburg position until Trendelenburg primary hook 161 or the reverse Trendelenburg primary hook 162 has securely engaged.

Figure 7:
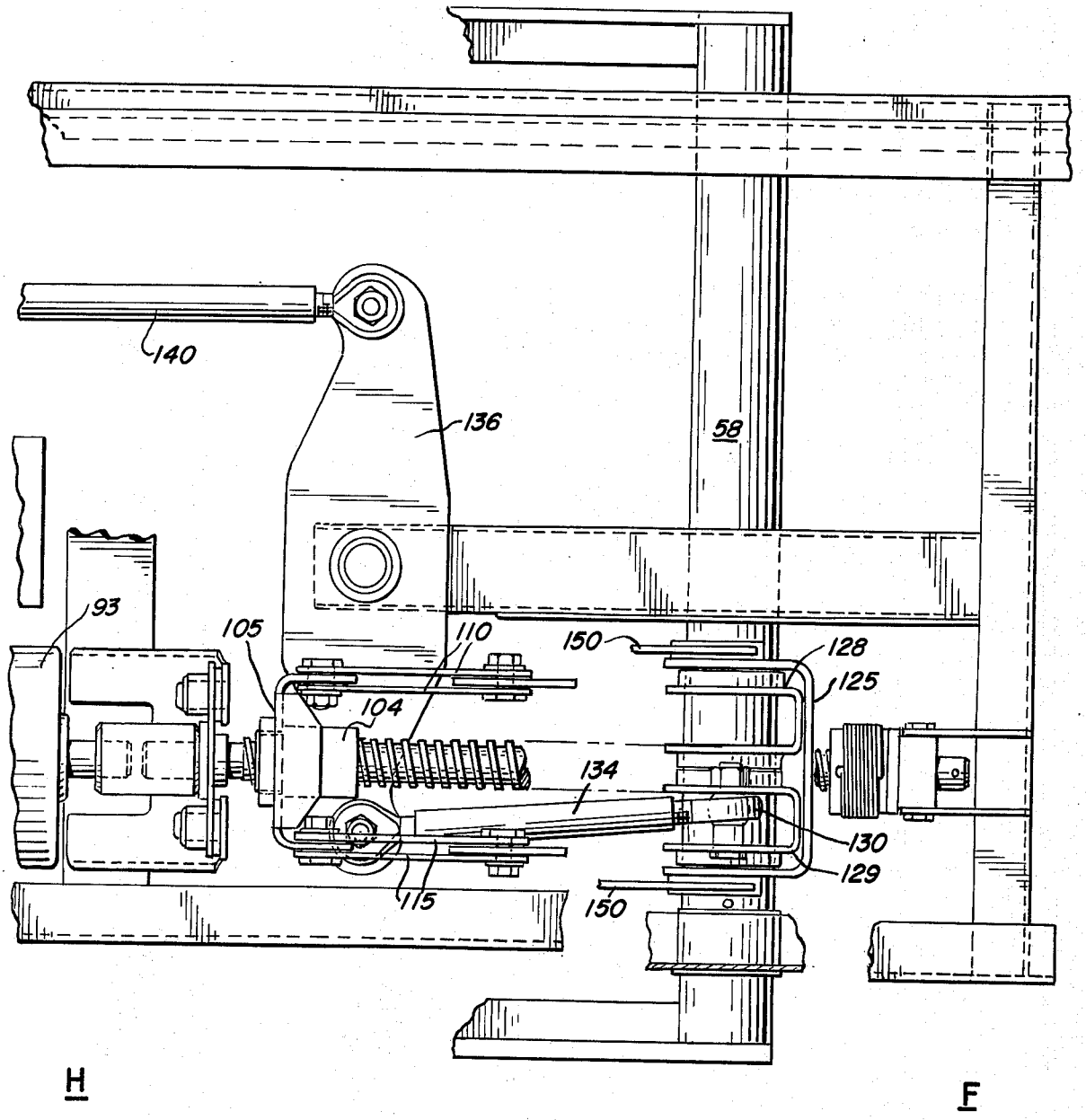
FIG. 7 gives a sectional view of the Trendelenburg mechanism from above.

To place the bed in either the Trendelenburg or reverse Trendelenburg position, the bed must first raise to its uppermost position. As shown in FIG. 7, this occurs by the motor 93 acting on the screw 104 and trunnion 105 to pull the connecting links 110 and 115 to the head H of the bed. This rotates the yoke 125 which abuts against the foot drive arm 128 to turn the torque tube 58 to raise foot F of the bed. The yoke 125 also rotates the pivotal head arm 129 which in turn pushes the rod 134 to rotate the pivot plate 136. The last motion pulls on the rod 140 which rotates the fixed head drive arm and the attached torque tubes to raise the head H of the bed.

Figure 8:
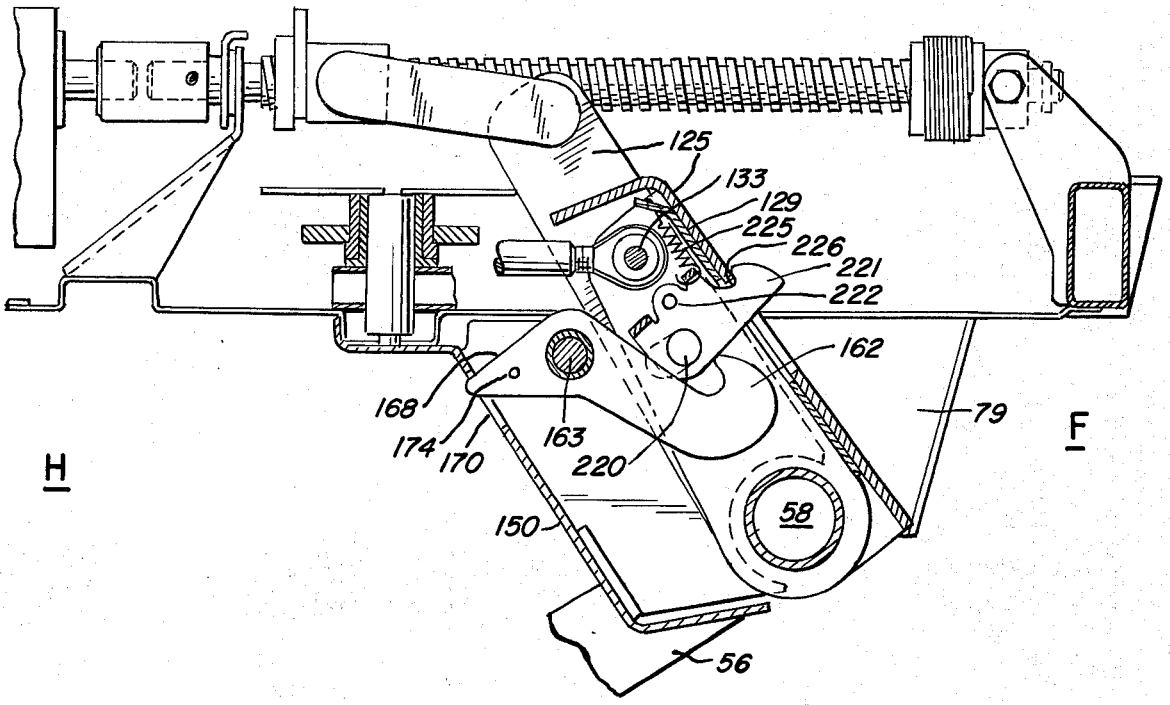
FIGS. 8, 9, 10 and 11 are side views in cross section of the Trendelenburg mechanism when the bed occupies, respectively, its position of maximum and minimum elevation, maximum Trendelenburg inclination, and maximum reverse Trendelenburg inclination.

FIG. 8 shows that for the reverse Trendelenburg position, for example, the uppermost position allows the reverse Trendelenburg primary hook 162 to engage the pin 220 of the reverse Trendelenburg secondary hook 221. If the bed has not assumed its uppermost position, as in FIG. 9, which shows the lowest position, the reverse Trendelenburg secondary hook 221 and with it its pin 220 sets removed from the reverse Trendelenburg primary hook 162. This occurs because the reverse Trendelenburg secondary hook 221 remains pivotally attached to the pivotal head drive arm 129 which rotates away from the primary hook 162 as the bed lowers.

With the bed in its uppermost position, however, primary hook 162 begins to engage the pin 220, becoming fully engaged as the bed begins to descend. As the bed further descends, the primary hook 162 begins to pull the pin 220 against the biasing of the spring 225.

Consequently, the secondary hook 221 pivots about the pin 213 to disengage its hook portion 217 from the yoke 125 to which it had previously latched. FIG. 8 shows the engagement of the hook portion 226 to the yoke 125 before the reverse Trendelenburg primary hook 162 engages the pin 220 of the reverse Trendelenburg secondary hook 221.

Figure 11:
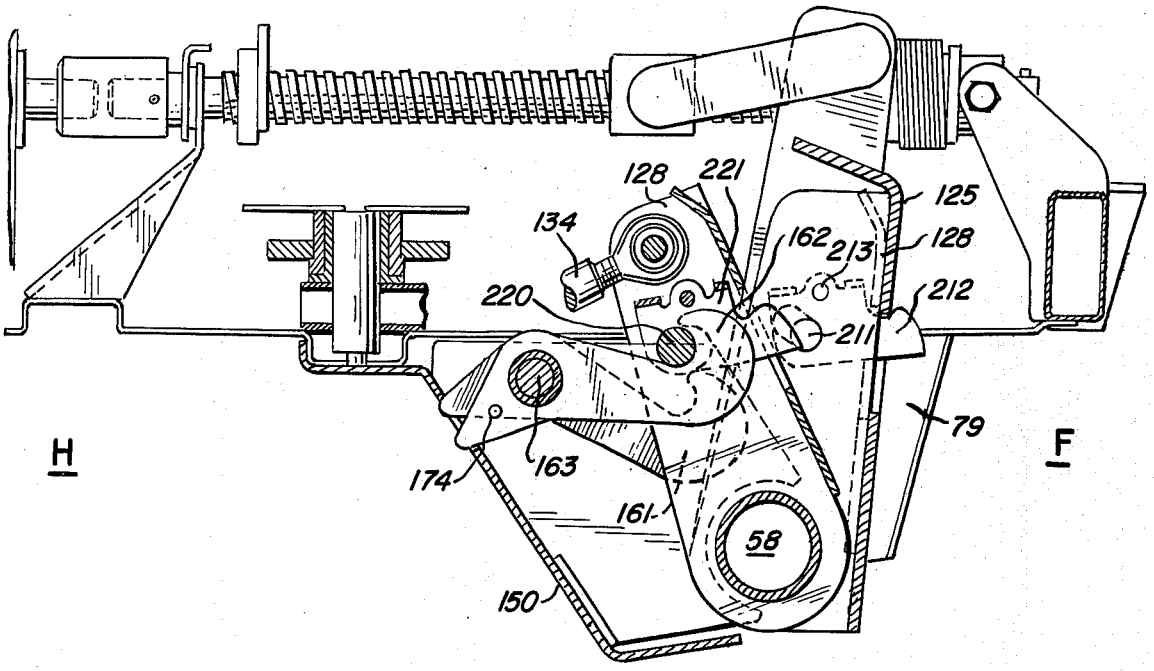

As the motor 93 continues to move the trunnion 105 further away, the yoke 125 continues to rotate towards the foot F of the bed. At this point the primary hook 162 has become securely engaged to the pin 220 causing the actual hook portion 226 of the secondary hook 220 to disengage from the yoke 125. With the secondary hook 221 engaged securely to the reverse Trendelenburg primary hook 162, the pivotal head drive arm 129 cannot follow the motion of the yoke 125 towards the foot F of the bed. Thus, though the yoke 125 rotates away from the motor 93, the pivotal head drive arm 129 remains fixed in space as shown in FIG. 11. Since the pivotal head drive arm 129 connects to the torque tube 64 through the rods 134 and 140, the pivot plate 136, and the fixed head drive arm 142, the lack of motion of the drive arm 129 precludes the torque tube 64 from rotating in the bracket 78. Accordingly, the head H of the bed does not descend.

Nonetheless, the motion of the motor rotating the yoke 125 towards the foot F of the bed permits the foot drive arm 128 to also rotate in that direction. Engagement of the Trendelenburg secondary hook 212 with the yoke 125, as well as the weight of the foot F of the bed, forces the foot drive arm 128 to rotate towards the foot F of the bed. As it does, the torque tube 58 pivots in the bracket 79 to lower the foot F of the elevating frame 72. The foot F of the bed resting lower than the head H represents the reverse Trendelenburg position.

The steepness of the reverse Trendelenburg position may increase until some mechanism prevents the further descent of the foot end. The switch 230 will activate when the side of the yoke 125 passes through two thirds of its arc as the bed lowers. This activation of the switch 230 will stop the bed from entering a steeper Trendelenburg or reverse Trendelenburg position.

Reversing the motor 93 will cause yoke 125 to approach the head H and take the bed out of the reverse Trendelenburg position. As the yoke 125 rotates, it abuts against the foot drive arm 128, which pivots the torque tube 58 to raise the foot F. This merely represents the normal elevating procedure as applied to the foot F of the bed.

However, near the limit of the yoke's 125 rotation towards the head H, it also reengages pivotal head drive arm 129, previously held away from it by the reverse Trendelenburg primary hook 162. The pivotal head drive arm 129 then rotates slightly towards the head H of the bed, moving the secondary hook 221 with it. As the secondary hook 221 moves, it begins to lift the pin 220 from the primary hook 162. The spring 225 rotates the secondary hook 221 which allows it to reengage the yoke 125.

Further, as the pin 220 of the secondary hook 221 becomes freed from the primary hook 162, and without the control lever 181 to hold it up, it again comes under the control of its own weight and the biasing of the spring 175. It accordingly rotates and resumes the position it occupied before moving into its position of engagement for the reverse Trendelenburg position. Thus, when the bed has about reached its uppermost position, it has fully departed the reverse Trendelenburg position.

Entering the Trendelenburg position basically proceeds by the same process as for the reverse Trendelenburg position. Rotating the control lever 182 to lower the arm 186 and the lever end 177 pivots the lever 171 about the opening 174 of the hook 162 and raises the primary Trendelenburg hook 161. At the same time, the bed begins to descend from its highest position. The pivotal head drive arm 129 follows the rotation of the yoke 125 towards the bed's foot F. Because of the rods 134 and 140 and the pivot plate 136, the fixed head drive arm 142 rotates the torque tube 64 in its bracket 78, and the head H of the bed declines normally. Further, the raised Trendelenburg primary hook 161 engages the pin 211 of the secondary hook 212. As the head H lowers, the secondary hook 212 rotates about the pin 213 to free its hook portion 217 from the yoke 125. The primary Trendelenburg hook 162 then securely engages and prevents the foot drive arm 128 from rotating the torque tube 58 in its bracket 79. Consequently, the foot F of the bed remains raised as the head declines to produce a Trendelenburg configuration. FIG. 9 shows the Trendelenburg mechanism while in this position.

Reversing the motion 93 will retrieve the bed from the Trendelenburg position. It pivots the yoke 125 towards the bed's head H which eventually rotates the fixed head drive arm 142 and the torque tube 64 to raise the head H. Further, the yoke 125 becomes reengaged with the secondary Trendelenburg hook 212 which disengages the primary hook 161 from the pin 211. Accordingly, the secondary hook 212 drops away and resumes its normal position. As the bed reaches its maximum elevation, the Trendelenburg mechanism becomes completely disengaged.

The foregoing discussion has started with the bed in its uppermost position prior to the raising of either the Trendelenburg or the reverse Trendelenburg primary hooks 161 or 162. However, since the knob 182 may also serve to induce the motor 93 to elevate the bed, the lever 172 will have raised either primary hook 161 or 162 while not in a position to engage either the pin 211 or the pin 220, respectively, of the secondary hooks 212 and 221. As the yoke 125 brings the hooks 212 and 221 closer to the primary hooks 161 and 162, the elevated primary hook then abuts against the pin it must engage to achieve the Trendelenburg position. However, the springs 190 and 191 on the screws 189 and 187, respectively, allow the pins 211 or 220 to override the lifting mechanism of either the hook 161 or the hook 162, depressing it, so that it may latch onto the pin when the bed rises sufficiently.

For example, to enter the Trendelenburg position, the control lever 181 rotates the tubes 184 and 185 to lower the arm 186 and the lever end 177 and raise the Trendelenburg primary hook 161. As yoke 125 approaches the head H of the bed, the pin 211 on the secondary hook 212 contacts the top cam surface of the Trendelenburg primary hook 161, exerting a downward force. With the arm 186 lowered, the force exerted on the top of the Trendelenburg primary hook 161 raises the lever end 177 and the link 188, which is abuts. However, the hole in the arm 186 has sufficient size to allow the shank of the screw 187 to pass through. When the pin 211 forces the end of the Trendelenburg hook 161 down, the screw 187 passes through the arm 186, compressing the spring 191.

Thus, while the spring 191 has sufficient extensive force to lower the link 188 when the arm 186 lowers, nonetheless, it will allow the link 188 to subsequently rise upon a downward force on the Trendelenburg hook 161 exerted by the pin 211. This sliding relationship between the screw 187 and the arm 186, controlled by the spring 191, allows the pin 211 to override the lifting mechanism on the Trendelenburg primary hook 161 and enter into a latching relationship.

Similarly, to place the bed in the reverse Trendelenburg position, the arm 186 raises the lever end 177 which, pivoting through the opening 173, raises the reverse Trendelenburg primary hook 162. The pin 220 of the reverse Trendelenburg secondary hook 221 then abuts the top cammed surface of the primary reverse Trendelenburg hook 162 upon the raising of the bed. The pin 220 exerts a downward force on the hook 162 and on the lever end 177. The opening in the end 177 is sufficiently large so that it slides over the shank of the screw 189 compressing the spring 190. When the pin 220 has passed into latching engagement with the hook 162, the spring 190 then forces the end of the lever 177 back upwards to raise the hook 162 and engage the pin 220.

The secondary hooks 212 and 221, in latching against the yoke 125, serve a further purpose. They prevent the separation of the elevating frame 72 from the base frame 20 upon the external raising of either end of the elevating frame 72. Engaging the hook 212 to the yoke 125 retains the yoke, which can pivot on the torque tube 58, to the foot drive arm 128 which does not pivot. Pulling on the foot end of the supporting frame 72 attempts to induce a pivoting of the torque tube 58 in the bracket 79 and of the foot drive arm 128 towards the bed's head H. The hook 212 latches to the yoke 125 and would force it to also pivot towards the head H of the bed. However, the yoke cannot experience this motion because of its fixed relationship to the motor 93 along the screw 97. Accordingly, the torque tube 58 cannot rotate and, consequently, pulling on the elevating frame 72 also pulls the base frame 20 to which the torque tube lift arms 56 attach at 57.

Similarly, the lifting of the head H of the elevating frame 72 results in the head of the base frame 20 accompanying it upwards. The lift arms 62 and the torque tube 64 have a fixed relationship to the fixed head drive arm 142 which, through the rods 140 and 135 and the pivot plate 136, remain fixed to the pivotal head drive arm 129. However, the hook 221 fixedly latches the pivotal head drive arm 129 to the yoke 125 which, as above, cannot rotate because of its attachment to the motor 93 through the screw 97. Thus, the lift arms 62 cannot rotate around the point 63 upon the lifting of the head end H of the elevating frame 72.

When in the Trendelenburg or reverse Trendelenburg position, however, the hooks 212 or 221, respectively, do not engage the yoke 125. As a result, relative motion between the elevating frame 72 and the base frame 20 becomes possible upon a lifting of the higher end of the elevating frame 72 in one of these positions.

In the Trendelenburg position, for example, the Trendelenburg primary hook 161 latches onto the pin 211 and disengages the Trendelenburg secondary hook 212 from the yoke 125. The pivoting of the yoke 125 towards the foot of the bed results in a separation between the yoke 125 and the foot drive arm 128.

Raising the foot end F of the elevating frame 72 rotates the torque tube 58 in its bracket 79. However, the yoke 125 and the pivotal head drive arm 129, to which it is attached by the hook 221, can both rotate about the torque tube 58. Thus, the yoke 125 retains the same fixed distance from the motor 93 by rotating around the torque tube 58 as the latter rotates in the bracket 79.

However, as the torque tube 58 rotates it also incurs an upward movement, lifting the foot drive arm 128 welded to it. This in turn raises the secondary hook 212 which connects to the foot drive arm 128 by the pin 222. When the secondary hook 212 raises sufficiently, the pin 211 no longer engages the Trendelenburg primary hook 161, which, because of its own weight and the spring 175, drops down onto its inactivated position, where it can no longer hold the foot of the bed F in the elevated position. The foot F may then descend, rotating the torque tube 58 and the torque tube drive arm 128 towards both the foot F and the yoke 125, in particular. This descent continues until the foot drive arm 128 abuts the yoke 125 and allows the hook 212 to reengage the yoke 125. When this occurs, the foot F of the bed will have lowered to the same level as the head H, departing from the Trendelenburg position. Thus, even though the electricity may fail, rendering the motor 93 inoperative, lifting the higher end of the bed allows it to resume the normal level position.

Accordingly, what is claimed is:

1. An adjustable bed comprising:

A. a rigid elevating frame;

B. two torque tubes pivotally attached to said frame and lying substantially parallel to and spaced apart from each other;

C. lifting means rigidly attached to and extending transversely from said torque tubes and capable of supporting said torque tubes and said frame;

D. drive means attached to said torque tubes for rotating said torque tubes;

E. motive means coupled to said drive means for moving said drive means to produce rotation of said torque tubes to raise and lower said frame;

F. retaining means movable into a position of engagement when said frame is at a predetermined elevation for preventing rotation of one of said torque tubes in a direction to lower said frame; and G. actuating means for moving said retaining means into said position of engagement, said actuating means being ineffective to move said retaining means when said retaining means is in a position of engagement.

2. The bed of claim 1 further including a base frame, wherein said lifting means attached to the first of said torque tubes are pivotally attached to said base frame and said lifting means attached to the second of said torque tubes are pivotally attached to pivot arms pivotally attached to said base frame.

3. The bed of claim 1 wherein said elevating frame has a longer and a shorter dimension and said torque tubes lie transverse to said longer dimension.

4. The bed of claim 3 including restraining means for,

1. when the ends of said frame are at substantially equal heights, preventing rotation of said torque tubes by means other than said drive means, and

2. when the ends of said frame are at substantially unequal heights, preventing rotation of the torque tube nearer the lower end of said frame by means other than said drive means.

5. The bed of claim 3 wherein said drive means, to raise said elevating frame, rotates the first of said torque tubes in a first direction and the second of said torque tubes in a direction opposite to said first direction, and, to lower said elevating frame, rotates said first torque tube in a second direction and said second torque tube in a direction opposite to said first torque tube.

6. The bed of claim 1 wherein said actuating means moves said retaining means into a first position of engagement to prevent the rotation of the first of said torque tubes in a direction to lower said frame and into a second position of engagement to prevent the rotation of the second of said torque tubes in a direction to lower said frame.

7. The bed of claim 1 wherein said drive means includes a first drive arm rigidly attached to the first of said torque tubes, a second drive arm rigidly attached to the second of said torque tubes, a third drive arm pivotally attached to said first torque tube, and interconnect means coupled between said second and third drive arms for producing substantially equal amounts of motion of said second and third drive arms.

8. The bed of claim 7 wherein said interconnect means includes a pivot plate pivotally attached to said frame, a first rod connected between said second drive arm and said pivot plate and a second rod connected between said pivot plate and said third drive arm.

9. The bed of claim 7 wherein said motive means includes a motor attached to said frame, a screw attached to said motor, translational means for producting translational motion from the rotation of said screw, and a yoke connected to said translational means and pivotally attached to said first torque tube in a position to, upon the translation of said translational means, abut said first and third drive arms.

10. The bed of claim 9 including first and second pins coupled to said first and third drive arms, respectively, and wherein said retaining means includes first and second primary hooks engageable with said first and second pins when said frame is at said predetermined elevation.

11. The bed of claim 10 wherein said predetermined elevation is substantially the maximum elevation of said frame.

12. The bed of claim 10 wherein said actuation means includes a rod, the rotation of which in a first direction moves said first primary hook into a position for engagement with said first pin and the rotation of which in a second and different direction moves said second primary hook into a position for engagement with said second pin.

13. The bed of claim 12 including first and second secondary hooks pivotally attached to said first and third drive arms, said first and second pins being connected to said first and second secondary hooks, respectively, said first secondary hooks being engaged with said yoke when said first primary hook is not in a position of engagement with said first pin and said second secondary hook being engaged with said yoke when said second primary hook is not in a position of engagement with said second pin.

14. An adjustable bed comprising:

A. a rigid frame;

B. elevating means coupled to said frame for raising and lowering said frame;

C. tilting means for, when said frame is at a predetermined elevation, retaining one end of said frame at about said predetermined elevation while said elevating means lowers the other end of said frame; and restraining means for, when both ends of said frame are at substantially equal elevation, preventing motion of said elevating means relative to said frame by means other than said elevating means.

15. The bed of claim 14 including release means for, when said tilting means has retained one end of said frame at about said predetermined elevation while the other end is at a lower elevation, releasing said tilting means upon the raising of said one end whereby said one end may lower to a height substantially equal to said other end.

16. The bed of claim 14 wherein said tilting means has two portions, the first portion retaining a first end while the other and second end lowers and the second portion retaining said second end while said first end lowers.

17. The bed of claim 14 wherein said frame is an elevating frame and said bed includes a base frame coupled to said elevating frame.

18. The bed of claim 14 wherein said frame has a longer and a shorter dimension and said elevating means include first and second torque tubes pivotally attached to said frame and lying transverse to said longer dimension and substantially parallel to and spaced apart from each other.

19. The bed of claim 18 wherein said elevating means further includes a first drive arm rigidly attached to said first torque tube, a second drive arm rigidly attached to said second torque tube and means for moving said drive arms to rotate said torque tubes.

20. The bed of claim 19 wherein said elevating means further includes a third drive arm pivotally attached to said first torque tube, a pivot plate pivotally attached to said frame, a first rod connected between said third drive arm and said pivot plate, a second rod connected between said pivot plate and said second drive arm, a motor attached to said elevating frame, a screw connected to said motor, a nut travelling along said screw as said screw turns, a yoke coupled to said nut and pivotally attached to said first torque tube in a position to abut said first and third drive arms, and two lift arms rigidly attached to and extending transversely from each of said torque tubes and capable of supporting said frame.

21. The bed of claim 20 wherein said motor is located substantially between said torque tubes.

22. The bed of claim 20 wherein said tilting means includes first and second pins coupled to said first and third drive arms, respectively, first and second hooks pivotally attached to said elevating frame and movable, when said elevating frame has substantially reached its maximum elevation, into a position of engagement with said first and second pins respectively, and actuating means for moving said hooks into said position of engagement, said actuating means being incapable of moving either hook when one of said hook has engaged one of said pins.

23. The bed of claim 22 wherein said first and second hooks are primary hooks and said elevating means includes first and second secondary hooks pivotally attached to said first and third arms respectively, said first and second pins being connected respectively to said first and second secondary hooks, said first secondary hooks engaging said yoke except when said first primary hook engages said first pin and said second secondary hook engaging said yoke except when said second primary hook engages said second pin.

24. An adjustable bed comprising:

A. a rigid frame having a longer and a shorter dimension;

B. two torque tubes pivotally attached to said frame lying transverse to the longer dimension of said frame and substantially parallel to and spaced apart from each other;

C. lifting means rigidly attached to and extending transversely from said torque tubes and capable of supporting said frame;

D. drive means attached to said torque tubes for rotating each of said torque tubes; and E. motive means coupled to said drive means for 1. moving said drive means in first directions to produce rotation of said torque tubes in opposite directions to raise said frame, and 2. moving said drive means in second directions to produce rotation of said torque tubes in opposite directions to lower said frame.

25. The bed of claim 24 wherein said motive means is a motor located substantially between said torque tubes; a screw attached to said motor; and a nut on said screw coupled to said drive means.

26. The bed of claim 25 wherein said drive means includes a yoke coupled to said nut and pivotally attached to the first of said torque tubes, a first drive arm rigidly attached to said first torque tube, a second drive arm rigidly attached to the second of said torque tubes, a third drive arm pivotally attached to said first torque tube, said yoke and said first and third drive arms being located such that the rotation of said yoke in a direction to elevate said frame will abut said first and third drive arms, a pivot plate pivotally attached to said frame, a first rod connected between said third drive arm and said pivot plate, and a second rod connected between said second drive arm and the side of said pivot plate opposite to the point of attachment of said first plate to said frame from said first rod.

27. The bed of claim 26 including (*a*) first and second hooks pivotally attached to said frame and, when said frame is substantially at its maximum elevation, movable into a position of engagement with said first and third drive arms, respectively, when said motor moves said yoke in a direction to lower said bed, and (*b*) an actuating rod coupled to said first and second hooks, the rotation of said rod in a first direction moving said first hook into a position for engagement with said first drive arm and the rotation of said rod in a second direction moving said second hook into a position for engagement with said third drive arm, the engagement of said first or second hook with said first or second drive arm, respectively, precluding the movement of either said first or second hook by said actuating rod.

28. An adjustable bed comprising:

A. a rigid elevating frame having a longer and shorter dimension;

B. a rigid base frame;

C. first and second torque tubes pivotally attached to one of said frames and lying substantially parallel to and spaced apart from each other;

D. lift arms rigidly attached to and extending transversely from said torque tubes and coupled to the other of said frames;

E. a first drive arm rigidly attached to said first torque tube, a second drive arm rigidly attached to said second torque tube, and a third drive arn pivotally attached to said first torque tube;

F. a rigid interconnect means coupled between said second and third drive arms for limiting said second and third drive arms to substantially equal amounts of rotation about axes through said second and first torque tubes respectively;

G. a yoke pivotally attached to said first torque in a location to abut, upon rotation about said first torque tube, said first and third drive arms;

H. motive means connected to said yoke for rotating said yoke, while in abutment with at least one of said first and third drive arms, about said first torque tube;

I. first Trendelenburg retaining means attached to the same frame as said torque tubes, and engageable with said first drive arm when said elevating frame substantially reaches its maximum elevation for preventing rotation of said first drive arm in the direction to lower said elevating frame;

J. second Trendelenburg retaining means attached to the same frame as said first Trendelenburg retaining means and engageable with said third drive arm when said elevating frame reaches substantially its maximum elevation for preventing rotation of said third drive arm in the direction to lower said elevating frame; and K. actuating means coupled to said first and second Trendelenburg retaining means for moving said first and second Trendelenburg retaining means into a position of engagement with said first and third drive arms, respectively, said actuating means being unable to simultaneously move said first and second Trendelenburg retaining means.

29. The bed of claim 28 wherein said torque tubes are attached to said elevating frame.

30. The bed of claim 29 wherein said torque tubes lie substantially transverse to the longer dimension of said elevating frame.

31. The bed of claim 30 wherein said interconnect means includes at least one rod coupled between said second and third drive arms.

32. The bed of claim 31 wherein said interconnect means includes:

1. a pivot plate pivotally attached to said elevating frame;

2. a first rod connected between said third drive arm and said pivot plate; and 3. a second rod connected between said pivot plate and said second arm such that said torque tubes rotate in opposite directions when said elevating frame elevates.

33. The bed of claim 32 wherein said motive means includes a motor coupled to said elevating frame, a screw attached to said motor, and a nut travelling along said screw as said motor turns and coupled to said yoke.

34. The bed of claim 33 wherein said motor is located between said torque tubes.

35. The bed of claim 34 wherein said first and second Trendelenburg retaining means are first and second hooks, respectively, pivotally attached to said elevating frame, and said first and third drive arms include respectively first and second pins engageable by said first and second hooks, respectively.

36. The bed of claim 35 wherein said actuating means includes a rotatable rod, the rotation of which in a first direction moves said first hook into a position for engagement with said first pin, and the rotation of which in a second direction moves said second hook into a position for engagement with said second pin.

37. The bed of claim 36 including, said first and second hooks being primary hooks, first and second secondary hooks pivotally attached to said first and third drive arms respectively wherein (*a*) said first and second pins attach respectively to said first and second secondary hooks; (*b*) said first secondary hook, only when said first primary hook is not in a position of engagement with said first pin, engages said yoke; and (*c*) said second secondary hook, only when said second primary hook is not in a position of engagement with said second pin, engages said yoke.

38. The bed of claim 37 including a lever with a double-center pivot connected between said rotatable rod and said first and second primary hooks, the rotation of said rod in said first direction pivoting said lever about a center coplanar with said second primary hook and the rotation of said rod in said second direction pivoting said lever about a point coplanar with said first primary hook.

39. The bed of claim 38 wherein the lift arms attached to one of said torque tubes are pivotally attached to said base frame and the lift arms attached to the other of said torque tubes are pivotally attached to lift arms pivotally attached to said base frame.

40. The bed of claim 39 wherein said first and second primary hooks have cam surfaces and the interconnection between said rod and said lever includes spring means for allowing said first and second primary hooks, when in a position of engagement, to engage, respectively, said first and second pins when said elevating frame is elevated.

41. The bed of claim 40 wherein:

a. when said first primary hook has engaged said first pin, the raising of the end of said elevational frame nearer said first torque tube will disengage said first primary hook from said first pin and allow said first secondary hook to pivot about its attachment to said first drive arm to engage said yoke; and b. when said second primary hook has engaged said second pin, the raising of the end of said elevational frame nearer said second torque tube will disengage said second primary hook from said second pin and allow said second secondary hook to pivot about its attachment with said third drive arm to engage said yoke.

* * * * *